US007743970B2

(12) United States Patent
Bates et al.

(10) Patent No.: US 7,743,970 B2
(45) Date of Patent: Jun. 29, 2010

(54) CARTON WITH REINFORCED END HANDLES

(75) Inventors: Aaron Bates, Powder Springs, GA (US); John M. Holley, Jr., Smyrna, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 794 days.

(21) Appl. No.: 11/320,542

(22) Filed: Dec. 28, 2005

(65) Prior Publication Data

US 2006/0278689 A1 Dec. 14, 2006

Related U.S. Application Data

(60) Provisional application No. 60/690,412, filed on Jun. 13, 2005, provisional application No. 60/715,792, filed on Sep. 9, 2005.

(51) Int. Cl.
*B65D 5/46* (2006.01)

(52) U.S. Cl. ..... 229/117.16; 229/117.13; 206/427

(58) Field of Classification Search ..... 229/117.16, 229/117.13, 918, 172, 174, 175, 176
See application file for complete search history.

(56) References Cited

U.S. PATENT DOCUMENTS

| | | | | |
|---|---|---|---|---|
| 2,122,654 | A | 7/1938 | Nickerson | |
| 2,196,502 | A | 4/1940 | Kells | |
| 2,660,363 | A * | 11/1953 | Trickett, Jr. et al. | 229/193 |
| 2,702,155 | A | 2/1955 | Baumann | |
| 2,857,090 | A * | 10/1958 | Fallert | 229/154 |
| 3,203,613 | A | 8/1965 | Stowe | |
| 3,933,300 | A | 1/1976 | Dempster | |
| 4,046,309 | A | 9/1977 | Poggiali | |
| 4,101,048 | A * | 7/1978 | Rieben et al. | 229/169 |
| 4,319,710 | A * | 3/1982 | Osborne | 229/238 |
| 4,482,090 | A | 11/1984 | Milliens | |
| 5,072,876 | A | 12/1991 | Wilson | |
| 5,350,109 | A | 9/1994 | Brown et al. | |
| 6,085,969 | A | 7/2000 | Burgoyne | |
| 6,250,542 | B1 * | 6/2001 | Negelen | 229/117.16 |
| 6,968,992 | B2 | 11/2005 | Schuster | |

FOREIGN PATENT DOCUMENTS

| | | | |
|---|---|---|---|
| GB | 2324293 | A | 10/1998 |

* cited by examiner

*Primary Examiner*—Nathan J Newhouse
*Assistant Examiner*—Christopher Demeree
(74) *Attorney, Agent, or Firm*—Tsugihiko Suzuki

(57) ABSTRACT

A reinforced handle is provided in an end wall closure of a sleeve type carton by forming a handle aperture in a top end flap, and by aligning the handle aperture with corresponding cutouts formed in respective side end flaps, each cutout being reinforced with one or more reinforcing panels that align with at least its weight bearing edge. Each reinforcing panel is hingedly attached to the respective side end flap to be foldable along the hinged connection and secured in a face contacting arrangement, whereby the reinforcing panel overlies the cutout as an overlay panel, or aligns its edge with the weight bearing edge of the cutout. In this manner, the material at the weight bearing edge of the cutout is at least two plies thick. When the carton is fully erected and sealed, the reinforced cutout is in registry with the handle aperture, thereby creating the reinforced handle.

20 Claims, 8 Drawing Sheets

CARTON WITH REINFORCED END HANDLES

RELATED APPLICATION

This application claims the benefit of the filing of Provisional Patent Application Ser. No. 60/690,412, entitled "Carton with Reinforced End Handles" and filed on Jun. 13, 2005, and of the filing of Provisional Patent Application Ser. No. 60/715,792, entitled "Carton with Reinforced End Handles" and filed on Sep. 9, 2005, the entirety of each being incorporated by reference.

TECHNICAL FIELD

This invention relates generally to a carton having a reinforced integrated handle opening in an end wall, and particularly, to a carton formed from a single blank.

BACKGROUND OF THE INVENTION

Carton manufacturers often face the challenge of providing a carton having ergonomic handle openings that are sufficiently strong to withstand the stress generated by the weight of articles enclosed. This is particularly so when the handle is integral to the end wall of the carton and when the burst strength of the material comprising the end wall is insufficient to avoid failure of the handle and the end wall itself. One approach to resolving this quandary is to construct the carton from a stronger material such as corrugated board or from a sheet of material of a relatively higher caliper. As fully enclosed cartons typically have six walls (top, sides, bottom, and ends) that are formed from a single sheet of material, and cost tends to increase according to the strength and thickness of material used to construct the carton walls, this approach is an expensive one because it effectively amounts to reinforcing all because it effectively amounts to reinforcing all of the walls of the carton irrespective of the relative magnitude of the forces borne by each wall.

According to another approach, additional material is applied to or around the handle as needed to its integrity as well as that of the end wall. For instance, a handle aperture in a carton end wall may be reinforced by outlining its edges with an additional layer of sheet material. However, it is often preferable to form a carton from a single sheet of material rather than to attach additional components to a carton or carton blank.

What is needed is a carton that is formed from a single blank, and which provides a reinforced integrated handle opening disposed in an end wall, where the carton walls are efficiently constructed without wasting expensive material in carton walls that are less likely to fail.

SUMMARY OF THE INVENTION

The various embodiments of the present invention overcome the shortcomings of the prior art by providing a sleeve type carton formed from a single sheet of paperboard or other foldable sheet material, the carton having a handle opening disposed in an end wall, wherein at least the weight bearing portion of the periphery of the handle opening is reinforced by three layers of sheet material.

More specifically, the various embodiments of the exemplary carton include a top panel, a first side panel hingedly connected to the top panel, a bottom panel hingedly connected to the first side panel, a second side panel hingedly connected to the bottom panel, and at least one end closure.

The end closure is formed from a top end flap hingedly connected to the top panel, the top end flap including a handle opening disposed therethrough. The end closure also includes side end flaps hingedly connected to the first and second side panels respectively, each side end flap including a cutout disposed at an outer edge or as an endless edged aperture, the cutout having dimensions complementary to the dimensions of at least part of the handle opening. Each side end flap also includes a reinforcing panel having a reinforcing edge, the reinforcing panel being foldable to place its reinforcing edge in reinforcing proximity to the respective cutout. The top end flap is foldable to at least partially overlie the first and second side end flaps so that the handle opening in the top end flap is in registry with the cutouts in the first and second side end flaps.

In one embodiment, each side end flap includes a notched cutout disposed at an outer edge, the notched cutout having dimensions complementary to the dimensions of at least part of the handle opening. An overlay panel hingedly connected along a transverse edge of each side end flap includes a complementary notched cutout. The overlay panel is foldable along the transverse edge into a face contacting arrangement with the side end flap, such that the cutout in the overlay panel is in registry with the cutout in the side end flap. Each side end flap also includes a reinforcing panel having a reinforcing edge, the reinforcing panel being foldable to place its reinforcing edge in reinforcing proximity to the cutouts in the respective side end flaps and overlay panels, thereby creating a notched cutout that is three plies thick along the hand-engaging portion. The side end flaps at an end of the erected carton are folded inwardly such that the outer edges abut one another and the respective three-ply notched cutouts align to approximate the shape of the handle opening. The top end flap is foldable to at least partially overlie the first and second side end flaps and overlay panels so that the handle opening in the top end flap is in registry with the three-ply notched cutouts in the first and second side end flaps, creating a handle section that is four plies thick along its hand engaging portion.

In an alternative embodiment, each overlay panel is hingedly connected to the respective side end flap along the outer longitudinal edge of the side end flap and includes a cutout that is a mirror image of the cutout in the side end flap. Together, the cutouts in the overlay panel and the adjacent side end flap form an endless edged aperture that is bisected by the outer edge of the side end flap, which is defined by a fold line.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
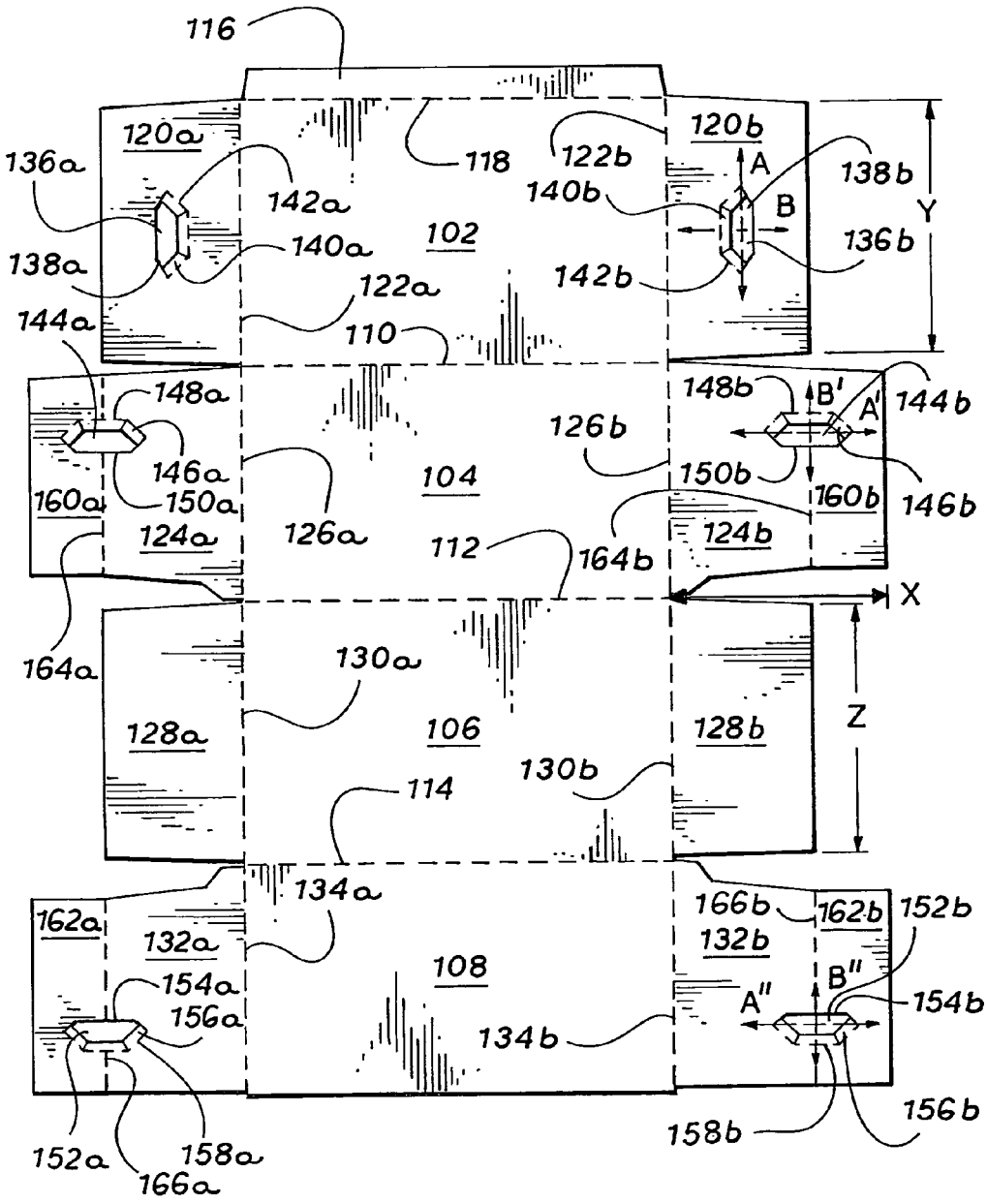
FIG. 1 is a plan view of a blank for forming a carton according to a first exemplary embodiment of the invention.

As required, detailed embodiments of the present invention are disclosed herein. It will be understood that the disclosed embodiments are merely examples to illustrate aspects of the invention that may be embodied in various and alternative forms. The figures are not necessarily to scale, and some features may be exaggerated or minimized to show details of particular components. In other instances, well-known materials or methods have not been described in detail to avoid obscuring the present invention. Therefore, specific structural and functional details disclosed herein are not to be interpreted as limiting, but as a basis for the claims and for teaching one skilled in the art to variously employ the present invention.

Referring now to the drawings in which like numerals indicate like elements throughout the several views, the drawings illustrate certain of the various aspects of exemplary embodiments of a carton having reinforced end handles. The exemplary embodiments of the carton of the present invention are for enclosing, carrying, and dispensing articles such as beverage cans or bottles, although the cartons of the present invention may be utilized to package any suitable article. Generally described, the exemplary cartons are formed from a foldable sheet material such as paperboard, corrugated board, plastic, or the like.

Referring now to FIG. 1, to manufacture the first exemplary carton 200, blank 100 is cut from a single sheet of the foldable sheet material, although it is contemplated that the blank 100 may include several separate panels that are secured together. The inside surface the blank 100 is shown. The blank 100 includes four major panels, namely, a top panel 102, a first side panel 104, a bottom panel 106, and a second side panel 108. The panels 102, 104, 106, 108 are hingedly connected to one another along the length of the blank. More specifically, a side edge of top panel 102 is hingedly connected along fold line 110 to a side edge of first side panel 104. A side edge of first side panel 104 is hingedly connected along fold line 112 to a side edge of bottom panel 106. A side edge of bottom panel 106 is hingedly connected along fold line 114 to a side edge of second side panel 108. The other side edge of top panel 102 is hingedly connected along fold line 118 to an edge flap 116, although any means for securing the second side panel 108 to the top panel 102 together may be used.

Each of the panels 102, 104, 106, 108 is also hingedly attached at each end edge thereof to end flaps for forming end closures at each end of the erected carton 200, as will be described in greater detail below. Top panel 102 is hingedly connected to top end flaps 120*a*, 120*b* at end edges defined by fold lines 122*a*, 122*b*. First side panel 104 is hingedly connected to first side end flaps 124*a*, 124*b* along end edges defined by fold lines 126*a*, 126*b*. Bottom panel 106 is hingedly connected to bottom end flaps 128*a*, 128*b* along end edges defined by fold lines 130*a*, 130*b*. Second side end panel 108 is hingedly connected to second side end flaps 132*a*, 132*b* along end edges defined by fold lines 134*a*, 134*b*.

To provide the reinforced end handles H (best shown in FIG. 5) on each end of the carton 200, handle openings having complementary dimensions and positions are provided in at least some of the end flaps. More specifically: top end flaps 120*a*, 120*b* include handle openings 136*a*, 136*b*; first side end flaps 124*a*, 124*b* include handle openings 144*a*, 144*b*; and second side end flaps 132*a*, and 132*b* include handle openings 152*a*, 152*b*, respectively.

Each of the handle openings 136*a*, 136*b*, 144*a*, 144*b*, 152*a*, 152*b* is an aperture defined by an endless edge (138*a*, 138*b*, 150*a*, 150*b*, 154*a*, 154*b*, respectively) that defines an ergonomic shape suitable for receiving the fingers of a user's hand so that the carton 200 can be lifted and carried easily. In the embodiment shown, the shape chosen includes an upper arch that conforms to the fingers of a hand. As depicted, the upper arch is defined by fold lines 142*a*, 142*b*, 148*a*, 148*b*, 158*a*, 158*b*, which enable cushioning flaps 140*a*, 140*b*, 146*a*, 146*b*, 156*a*, 156*b* to fold inward to cushion the fingers of the user's hand. Each handle opening 136*a*, 136*b*, 144*a*, 144*b*, 152*a*, 152*b* is elongated so as to have an axis of elongation A, A', A". The axes of elongation A of the handle openings 136*a*, 136*b* in the top end flaps 120*a*, 120*b* are substantially parallel to the end edges of the top panel 102 as defined by fold lines 122*a*, 122*b*, although it is contemplated that axes A may be disposed at an angle with respect to fold lines 122*a*, 122*b*. The axes of elongation A' of the handle openings 144*a*, 144*b* in the first side end flaps 124*a*, 124*b* are substantially perpendicular to the axes of elongation A, and thus in the exemplary embodiment, are also perpendicular to the end edges of the first side panel 104 as defined by fold lines 126*a*, 126*b*. The axes of elongation A" of the handle openings 152*a*, 152*b* in the second side end flaps 132*a*, 132*b* are also substantially perpendicular to the axes of elongation A, and thus in the exemplary embodiment, are similarly perpendicular to the end edges of the second side panel 108 as defined by fold lines 134*a*, 134*b*.

Each set of handle openings 136, 144, 152 also has a lateral axis B, B', B" that is perpendicular to axis of elongation A, A', A", the handle openings being symmetrical about the lateral axes.

Figure 3:
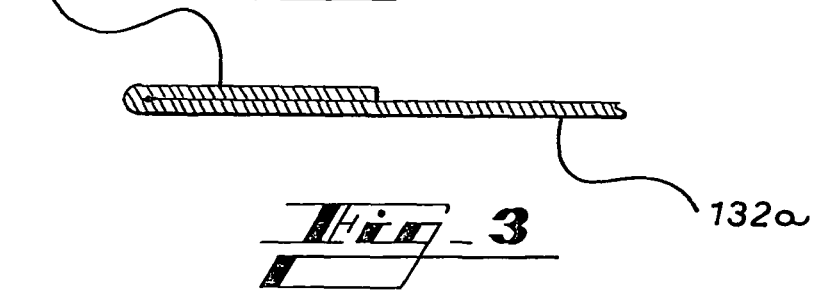
FIG. 3 is a view taken along the line III-III in FIG. 2, showing an exemplary reinforcing panel in face contacting arrangement with a side end flap.

As mentioned above, the handle openings 136*a*, 144*a*, 152*a* have complementary shapes, dimensions, and positions so as to be placed in registry with one another when the end flaps 120*a*, 124*a*, 132*a* are folded to overlie, overlap, or abut one another to form a first end closure 210 (shown in FIG. 3). Similarly, handle openings 136*b*, 144*b*, 152*b* are complimentarily shaped, dimensioned, and positioned so as to be placed in registry with one another when end flaps 120*b*, 124*b*, 132*b* are folded to overlie, overlap, or abut one another to form a second end closure 212 (shown in FIG. 3).

The dimensions and shapes of the end flaps 120*a*, 124*a*, 132*a* also correlate to be foldable to provide a composite end closure 210 with a reinforced end handle H. The width X of first side end flaps 124*a*, 124*b* and second side end flaps 132*a*,

132*b*, as defined by the distance from fold lines 126*a*, 126*b*, 134*a*, 134*b* to the outer edges of the respective end flap is no greater than the lesser of either the length Y of the end edges of top panel 102, as defined by fold lines 122*a*, 122*b* or the length Z of the end edges of the bottom panel 106, as defined by fold lines 130*a*, 130*b*. The end edges of the bottom panel 106 may be substantially equal in length to the end edges of the top panel 102, thereby creating a carton with a substantially rectangular tubular cross section. Alternatively, the end edges of top panel 102 may differ in length from the end edges of bottom panel 106, thereby creating an carton with a substantially trapezoidal cross section or a gabled tubular cross section (not shown) having shoulders, as is known in the art. The trapezoidal or gabled cross section with a relatively larger base is particularly useful to enclose tapered articles such as beer bottles.

The exemplary carton 200 may be erected around an article or group of articles, or may be at least partially erected and then loaded and sealed. To facilitate an understanding of the configuration of the carton 200, one of potentially many contemplated techniques for erecting the carton 200 will now be described as a series of steps that may be performed substantially simultaneously or in any practical order, with some or all of the steps being performed either manually or automatically, such as by a packaging machine.

The exemplary process of erecting the carton is performed in two stages. The first stage is performed typically as part of the process of manufacturing the carton 200. In the first stage, a blank is cut, folded and then secured into a flattened tubular condition so that it can be shipped to a packing facility as a sleeve. The following are the details: In plant equipment (IPE) at the manufacturing site cuts the blank 100 from a single sheet of foldable sheet material as described above, and cut, scores, imprints or otherwise defines fold lines, severance lines, and cutout sections. For instance, the edges 138*a*, 138*b*, 150*a*, 150*b*, 154*a*, 154*b* of handle openings 136*a*, 136*b*, 144*a*, 144*b*, 152*a*, 152*b* may be defined by weakened severance lines enabling the center sections to be punched out, or the 138*a*, 138*b*, 150*a*, 150*b*, 154*a*, 154*b* may be defined by cut lines with the center sections being removed and discarded before the carton 200 is erected.

After the blank 100 is cut out in the form shown in FIG. 1, adhesive or other means for securing is applied to the inside surface of an portion 160*a*, 160*b*, 162*a*, 162*b* of side end flap 124*a*, 124*b*, 132*a*, 132*b*. The portions 160*a*, 160*b*, 162*a*, 162*b* will hereinafter be referred to as reinforcing panels 160*a*, 160*b*, 162*a*, 162*b*. Each reinforcing panel 160*a*, 160*b*, 162*a*, 162*b* is defined by the end edge of respective side end flap 124*a*, 124*b*, 132*a*, 132*b*, to which the reinforcing panel 160*a*, 160*b*, 162*a*, 162*b* is connected along the respective fold line 164*a*, 164*b*, 166*a*, 166, which bisects the respective handle opening 144*a*, 144*b*, 152*a*, 152*b*, coinciding with the lateral axes thereof. In alternative embodiments, reinforcing panels may be separate pieces of sheet material that are applied as laminates to the side end flaps. Then, at or about the same time: reinforcing panel 160*a* is folded so that its inside surface is in face contacting arrangement with the underlying portion of the inside surface of side end flap 124*a*; reinforcing panel 160*b* is folded so that its inside surface is in face contacting arrangement with the underlying portion of the inside surface of side end flap 124*b*; reinforcing panel 162*a* is folded so that its inside surface is in face contacting arrangement with the underlying portion of the inside surface of side end flap 132*a*; and reinforcing panel 162*b* is folded so that its inside surface is in face contacting arrangement with the underlying portion of the inside surface of side end flap 132*b*. By this means, the reinforcing panels 160*a*, 160*b*, 162*a*, 162*b* are secured to the underlying portions of the inside surfaces of side end flap 124*a*, 124*b*, 132*a*, 132*b* respectively. FIG. 3 is a cross-sectional view showing reinforcing panel 162*a* and side end flap 132*a*, to aid in understanding the relationship between each of the reinforcing panels and the respective side end flap.

Figure 2:
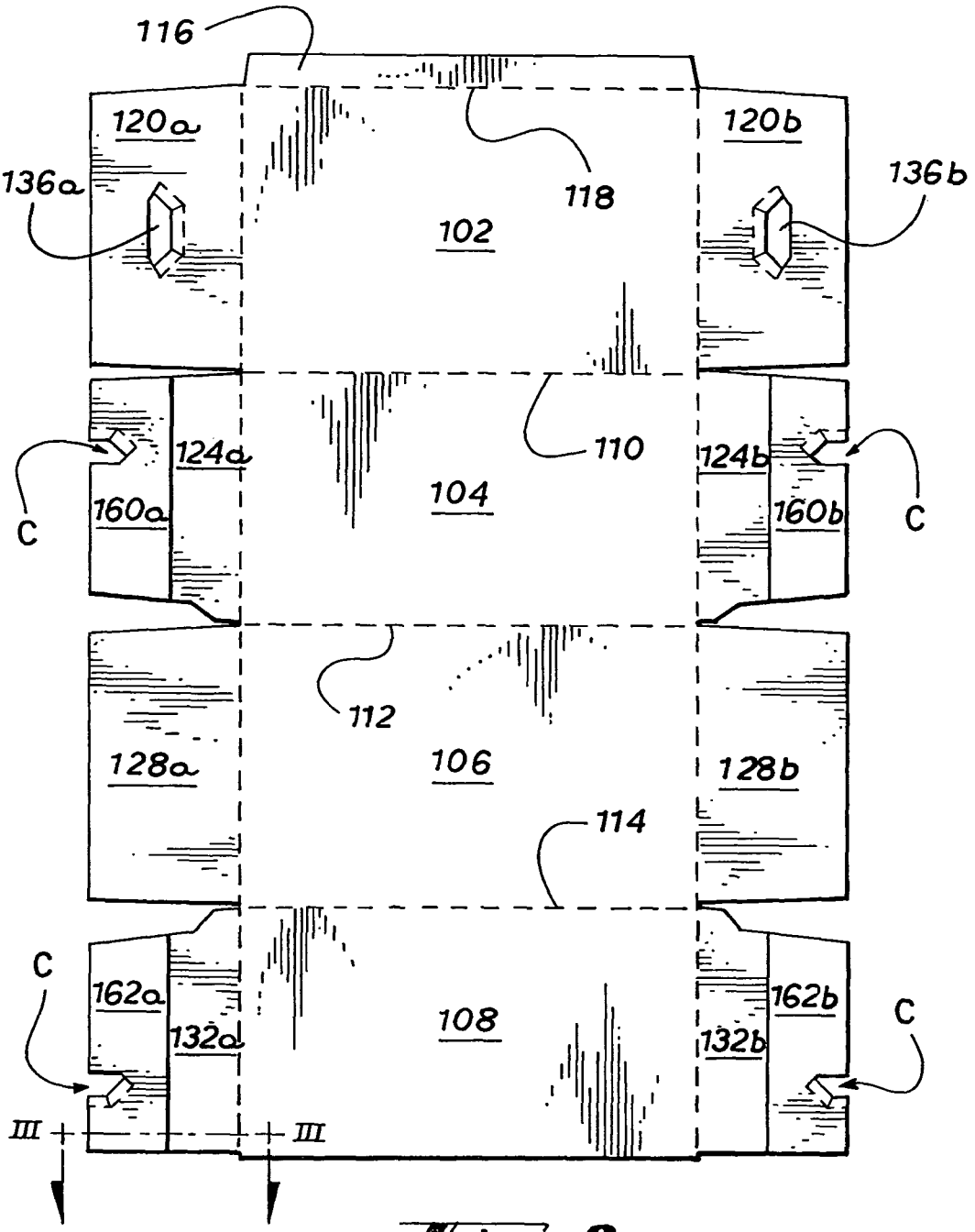
FIG. 2 is a plan view of the blank of FIG. 1, with reinforcing panels folded over and secured to the side end flaps.

At this point, the blank 100 is configured as shown in FIG. 2 By folding reinforcing panels 160*a*, 160*b*, 162*a*, 162*b* over onto respective side end flaps 124*a*, 124*b*, 132*a*, 132*b*, the handle openings 144*a*, 144*b*, 152*a*, 152*b* become doubly reinforced cutouts C. The doubling of the material around each cutout C is demonstrated by the cross-sectional view of FIG. 3, which is taken along III-III in FIG. 2 The first phase of the process is completed by applying adhesive or other securing means to the outside surface of edge flap 116, folding edge flap 116 so that its inside surface is in face contacting arrangement with the inside surface of top panel 102, and folding the entire blank 100 along fold line 112 so that the inside surface of top panel 102 is in face contacting arrangement with the inside surface of second side panel 108 and the outside surface of edge flap 116 is secured to the inside surface of second side panel 108.

Figure 4:
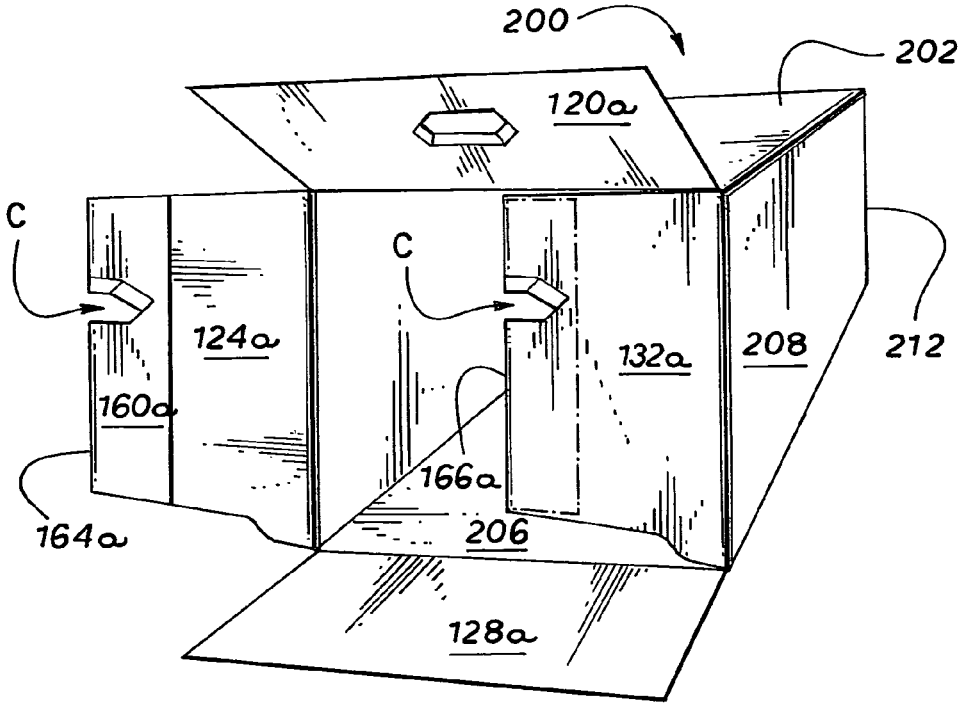
FIG. 4 is a perspective view of a partially erected carton formed from the blank of FIGS. 1 and 2, prior to sealing one of its end closures.

The second stage of erecting the carton 200 may be performed at a bottling or packaging facility. The flattened blanks 100 are loaded into a packaging machine, which in known fashion, disposes top panel 102 opposite bottom panel 106 and disposes first side panel 104 opposite second side panel 108 so that the carton 200 is configured as a tubular sleeve having a substantially rectangular as shown in FIG. 4, although trapezoidal or gabled cross sections are also contemplated. Thus, top panel 102 becomes top wall 202, first side panel 104 becomes first side wall 204, bottom panel 106 becomes bottom wall 206, and second side panel 108 becomes second side wall 208.

Articles are loaded into the carton 200 through one or both of the now open ends, and then the ends are sealed. The ends of the carton 200 are substantially identical, with similar parts being identified using the same element number modified by the suffix "a" or "b", where element numbers ending in "a" are associated with end closure 210, and elements identified with "b" are associated with end closure 212. Accordingly, formation of only one of the end closures 210, 212 will be described in detail below.

As can be seen in FIG. 4, first side panel 124*a* and second side panel 132*a* are folded toward the interior of the carton 200 until fold lines 164*a* and 166*a* abut or overlap slightly. In this manner, the cutouts C corresponding to handle openings 144*a* and 152*a* come together to approximate the dimensions of handle opening 136*a*. It should be noted that handle opening 136*a* may be relatively larger or smaller to account for slight variations in alignment. Adhesive is applied to the inside surface of bottom end flap 128*a*, and bottom end flap 128*a* is folded toward the interior of the carton 200 so that its inside surface is secured in a face contacting arrangement to the lower portions of the outside surfaces of side end flaps 124*a*, 132*a*. Adhesive is applied to the inside surface of top end flap 128*a*, and top end flap 128*a* is folded toward the interior of the carton 200 so that its inside surface is secured in a face contacting arrangement to the upper portions of the outside surfaces of side end flaps 124*a*, 132*a*. Top end flap 120*a* may overlap bottom end flap 132*a* somewhat (as shown in FIG. 5), or conversely, bottom end flap 132*a* may overlap top end flap 120*a*.

Figure 5:
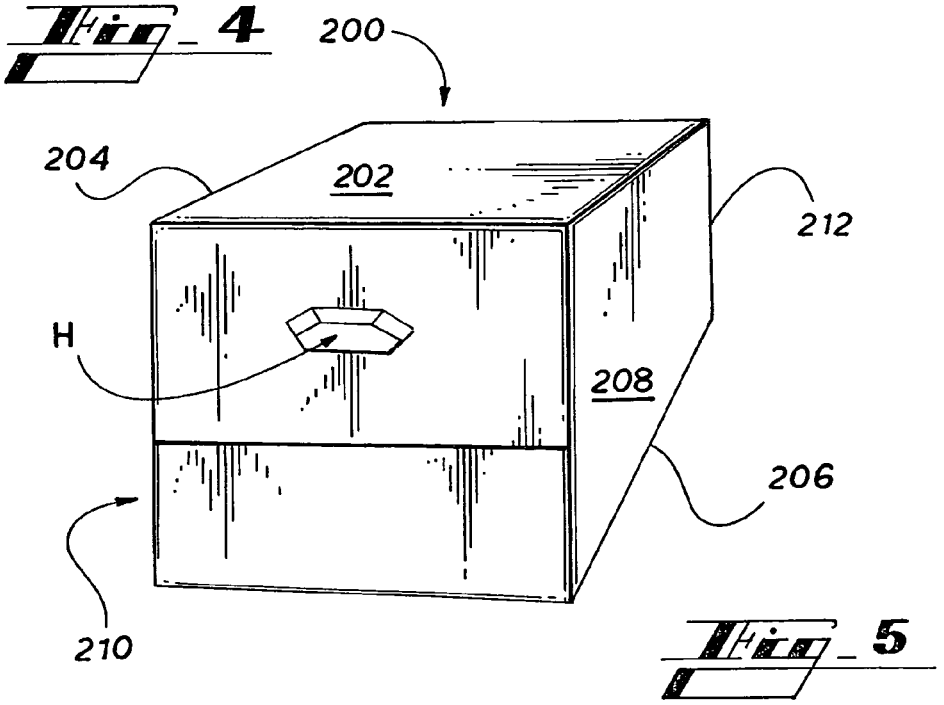
FIG. 5 is a perspective view of the carton of FIG. 4, in fully erected condition.

Once the carton 200 is fully erected as shown in FIG. 5, each end closure 210, 212 includes a handle H, the edges of which are triply reinforced. In other words, a portion of the periphery of the handle H as defined by edge 138*a* is substantially aligned with and reinforced by the doubled over edge

150*a* of handle opening 144*a*, and the remainder of the periphery of the handle H is substantially aligned with and reinforced by the doubled over edge 154*a* of handle opening 152*a*, making the area at or near all of the edges of the handle three plies thick.

Figure 6:
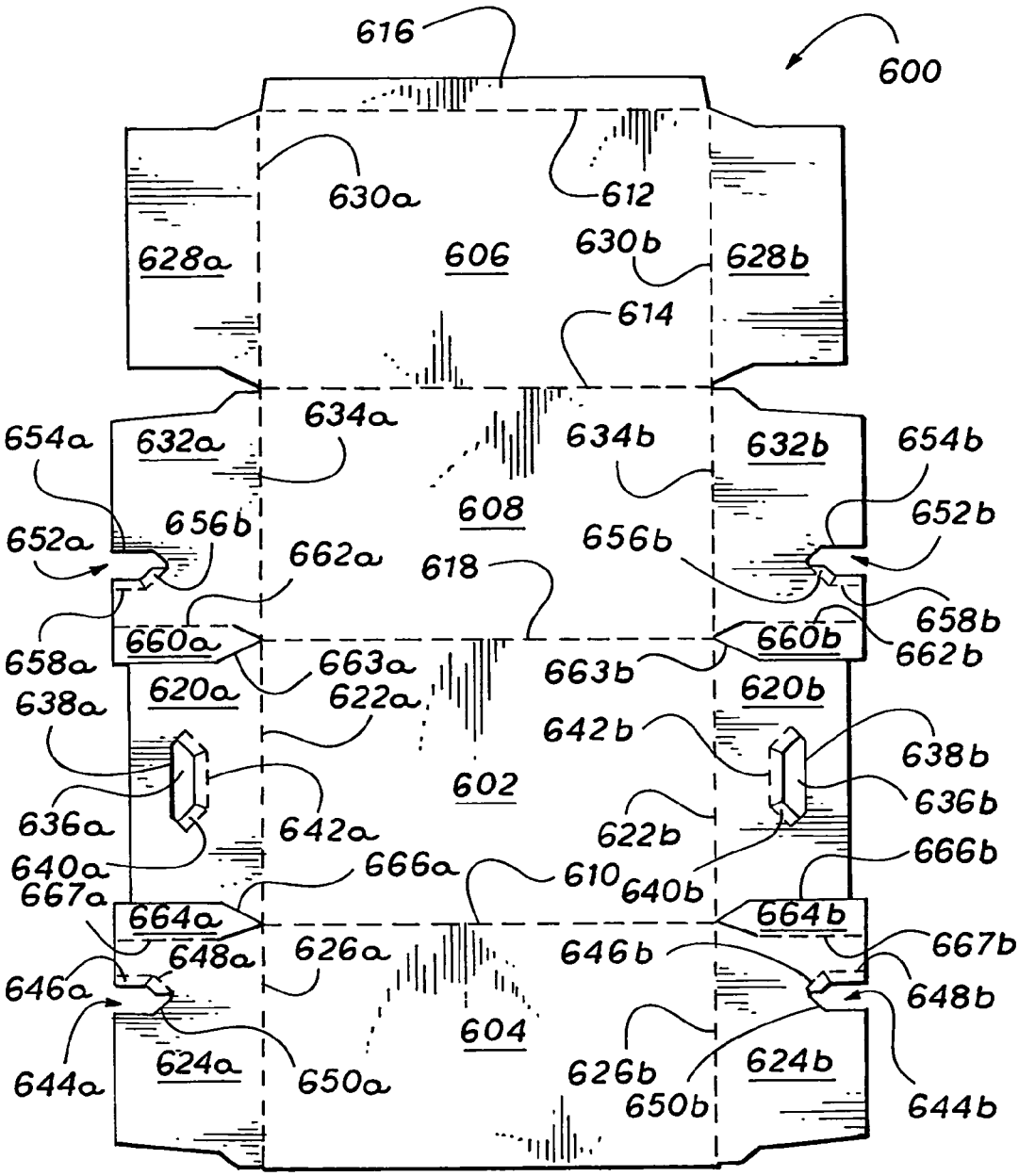
FIG. 6 is a plan view of a blank for forming a carton according to a second exemplary embodiment of the invention.

Those skilled in the art will readily appreciate that reinforcement is most needed along the weight-bearing portion of a handle opening in a carton. A second embodiment, carton 700 will now be described to exemplify the principles and teachings of the present invention. Carton 700 is formed from blank 600 (FIG. 6), and embodies an alternative configuration that provides triple reinforcement of the handle H, while consuming even less sheet material.

Figure 7:
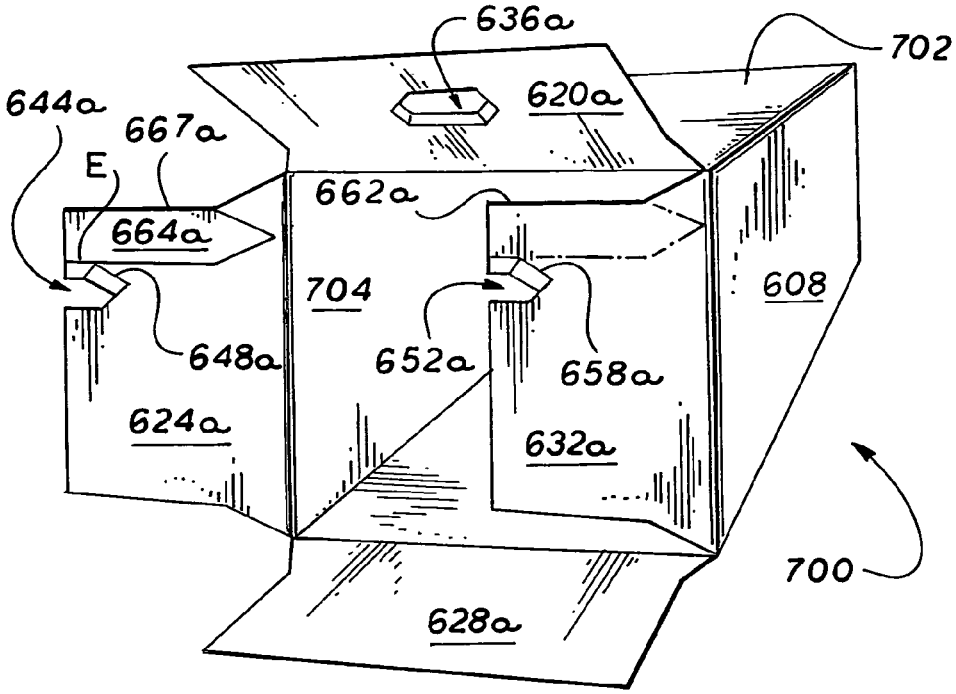
FIG. 7 is a perspective view of a partially erected carton formed from the blank of FIG. 6.

Generally, carton 700 differs from carton 200 principally by the substitution of cutouts 652*a*, 652*b*, 644*a*, 644*b* for handle openings in the side end flaps 632*a*, 632*b*, 624*a*, 624*b*, and by the alternative configuration of reinforcing panels 660*a*, 660*b*, 664*a*, 664*b*, which are partially detached along respective severance lines 663*a*, 663*b*, 666*a*, 666*b*, folded along respective fold lines 662*a*, 662*b*, 667*a*, 667*b* (which lie along the upper edges of the respective side end flap) and secured in a face contacting arrangement with the underlying portion of respective side end panels 632*a*, 632*b*, 624*a*, 624*b*. A portion of the edge of each of the reinforcing panels 660*a*, 660*b*, 664*a*, 664*b* is thereby placed in reinforcing proximity to the weight-bearing portion of cutout 652*a*, 652*b*, 644*a*, 644*b*. In the embodiment shown, and with reference to FIG. 7, the weight-bearing portion of cutout 652*a*, 652*b*, 644*a*, 644*b* is defined by at least part of fold line 658*a*, 658*b*, 648*a*, 648*b*, respectively. When the end closures 710, 712 are sealed, the reinforcing panels 660*a*, 660*b*, 664*a*, 664*b* are also in reinforcing proximity to the weight-bearing portions of handle opening 636*a*, 636*b*, defined by at least part of respective fold lines 642*a*, 642*b*.

The elements of blank 600 and carton 700 are otherwise substantially identical to the corresponding elements of blank 100 and carton 200. For instance, bottom panel 206 is substantially identical to bottom panel 606, and top wall 202 is substantially identical to top wall 702.

Figure 8:
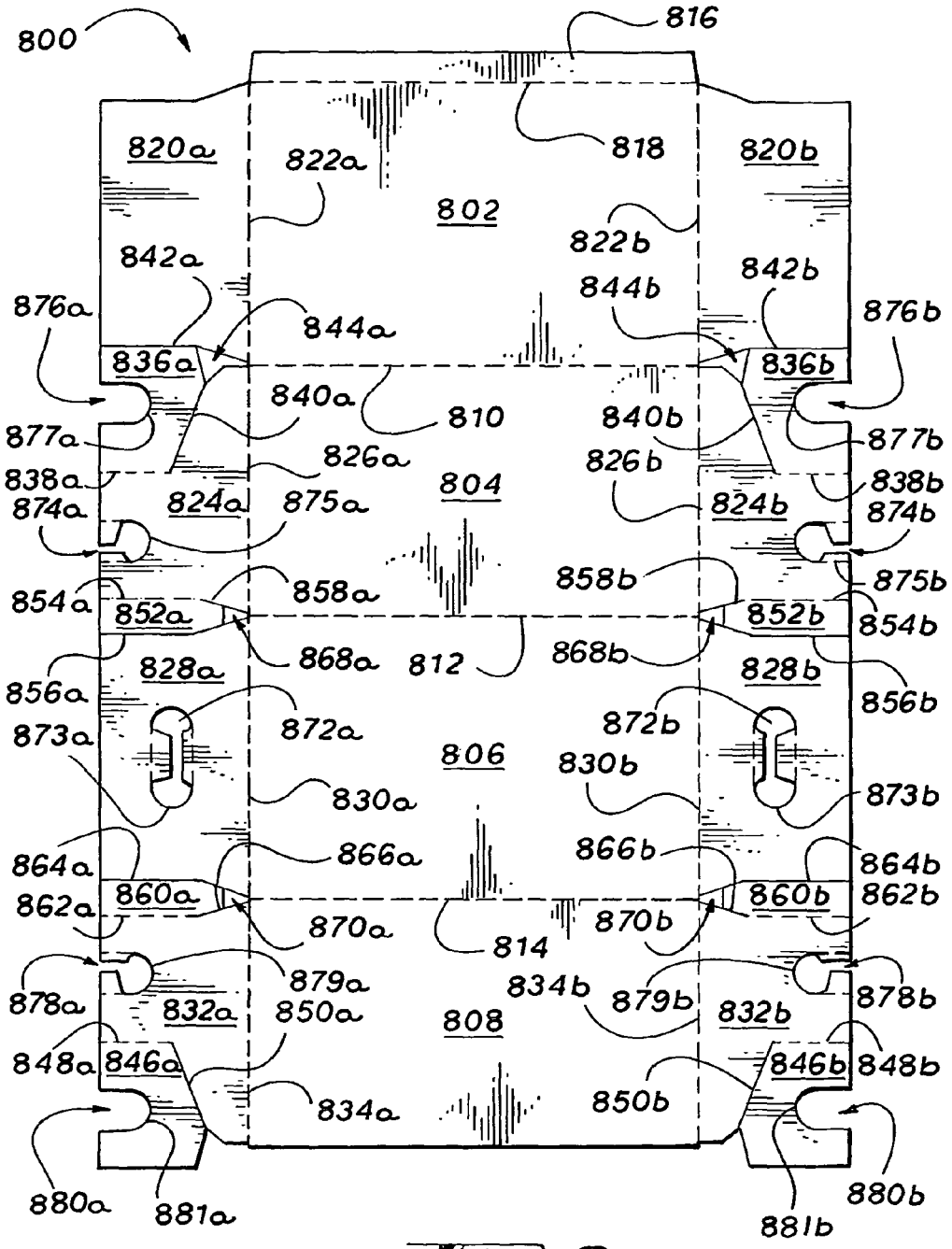
FIG. 8 is a plan view of a blank for forming a carton according to a third exemplary embodiment of the invention.

Referring now to FIG. 8, to manufacture the third exemplary carton 1100 (FIG. 11), blank 800 is cut from a single sheet of the foldable sheet material, although it is contemplated that the blank 800 may include several separate panels that are secured together. The inside surface the blank 800 is shown. The blank 800 includes four major panels, namely, a bottom panel 802, a first side panel 804, a top panel 806, and a second side panel 808. The panels 802, 804, 806, 808 are hingedly connected to one another along the length of the blank. More specifically, a transverse side edge of bottom panel 802 is hingedly connected along fold line 810 to a side edge of first side panel 804. A transverse side edge of first side panel 804 is hingedly connected along fold line 812 to a side edge of top panel 806. A transverse side edge of top panel 806 is hingedly connected along fold line 814 to a side edge of second side panel 808. The other side edge of bottom panel 802 is hingedly connected to an edge flap 816 along fold line 818, although any means for securing the second side panel 808 to the bottom panel 802 may be used.

Each of the panels 802, 804, 806, 808 is also hingedly attached at each end edge thereof to end flaps for forming end closures at each longitudinal end of the erected carton 1100, as will be described in greater detail below. Bottom panel 802 is hingedly connected to bottom end flaps 820*a*, 820*b* at end edges defined by fold lines 822*a*, 822*b*. First side panel 804 is hingedly connected to first side end flaps 824*a*, 824*b* along end edges defined by fold lines 826*a*, 826*b*. Top panel 806 is hingedly connected to bottom end flaps 828*a*, 828*b* along end edges defined by fold lines 830*a*, 830*b*. Second side end panel 808 is hingedly connected to second side end flaps 832*a*, 832*b* along end edges defined by fold lines 834*a*, 834*b*.

Each of the side end flaps 824*a*, 824*b*, 832*a*, 832*b* is hingedly connected at a transverse edge to an overlay panel and a reinforcing panel for forming the reinforced end handles, as will be described in greater detail below. First overlay panels 83*a*, 836*b* are hingedly connected to the lower edges of first side end flaps 824*a*, 824*b* along fold lines 838*a*, 838*b*, respectively. The first overlay panels 83*a*, 836*b* are formed at least in part from the first side end flaps 824*a*, 824*b*. The first overlay panels 83*a*, 836*b* are separated or separable from the first side end flaps 824*a*, 824*b* by severance lines 840*a*, 840*b*, respectively, and separated or separable from the bottom end flaps 820*a*, 820*b* by severance lines 842*a*, 842*b*, respectively. The blank 800 may include apertures 844*a*, 844*b* to facilitate folding the overlay panels 836*a*, 836*b* and reduce the amount of material used. Similarly, second overlay panels 846*a*, 846*b* are hingedly connected to the lower edges of the second side end flaps 832*a*, 832*b* along fold lines 848*a*, 848*b*, respectively. The second overlay panels 846*a*, 846*b* are formed at least in part from the second side end flaps 832*a*, 832*b*. The second overlay panels 846*a*, 846*b* are separated or separable from the second side end flaps 832*a*, 832*b* by severance lines 850*a*, 850*b*, respectively.

First reinforcing panels 852*a*, 852*b* are hingedly connected to the upper edges of first side end flaps 824*a*, 824*b* along fold lines 854*a*, 854*b*, respectively. The first reinforcing panels 852*a*, 852*b* are formed at least in part from the first side end flaps 824*a*, 824*b* respectively. The first reinforcing panels 852*a*, 852*b* are separated or separable from top end flaps 828*a*, 828*b* by severance lines 856*a*, 856*b*, respectively, and separated or separable from first side end flaps 824*a*, 824*b* by severance lines 858*a*, 858*b*, respectively. Similarly, second reinforcing panels 860*a*, 860*b* are hingedly connected to the upper edges of second side end flaps 832*a*, 832*b* along fold lines 862*a*, 862*b*, respectively. The second reinforcing panels 860*a*, 860*b* are formed at least in part from the second side end flaps 832*a*, 832*b*. The second reinforcing panels 860*a*, 860*b* are separated or separable from top end flaps 828*a*, 828*b* by severance lines 864*a*, 864*b*, respectively, and separated or separable from second side end flaps 832*a*, 832*b* by severance lines 866*a*, 866*b*, respectively. The blank 800 may include apertures 868*a*, 868*b* to facilitate folding the reinforcing panels 852*a*, 852*b* and may include apertures 870*a*, 870*b* to facilitate folding the reinforcing panels 860*a*, 860*b*, respectively. In alternative embodiments, overlay panels and reinforcing panels may be separate pieces of sheet material that are applied as laminates to the side end flaps.

To provide the reinforced end handles (not shown) on each end of the carton 1100, handle openings and notched cutouts having complementary dimensions and positions are provided in at least some of the end flaps and overlay panels. More specifically: top end flaps 828*a*, 828*b* include handle openings 872*a*, 872*b*; first side end flaps 824*a*, 824*b* include notched cutouts 874*a*, 874*b*; first overlay panels 836*a*, 836*b* include notched cutouts 876*a*, 876*b*; second side end flaps 832*a*, 832*b* include notched cutouts 878*a*, 878*b*; and second overlay panels 846*a*, 846*b* include notched cutouts 880*a*, 880*b*, respectively.

Figure 11:
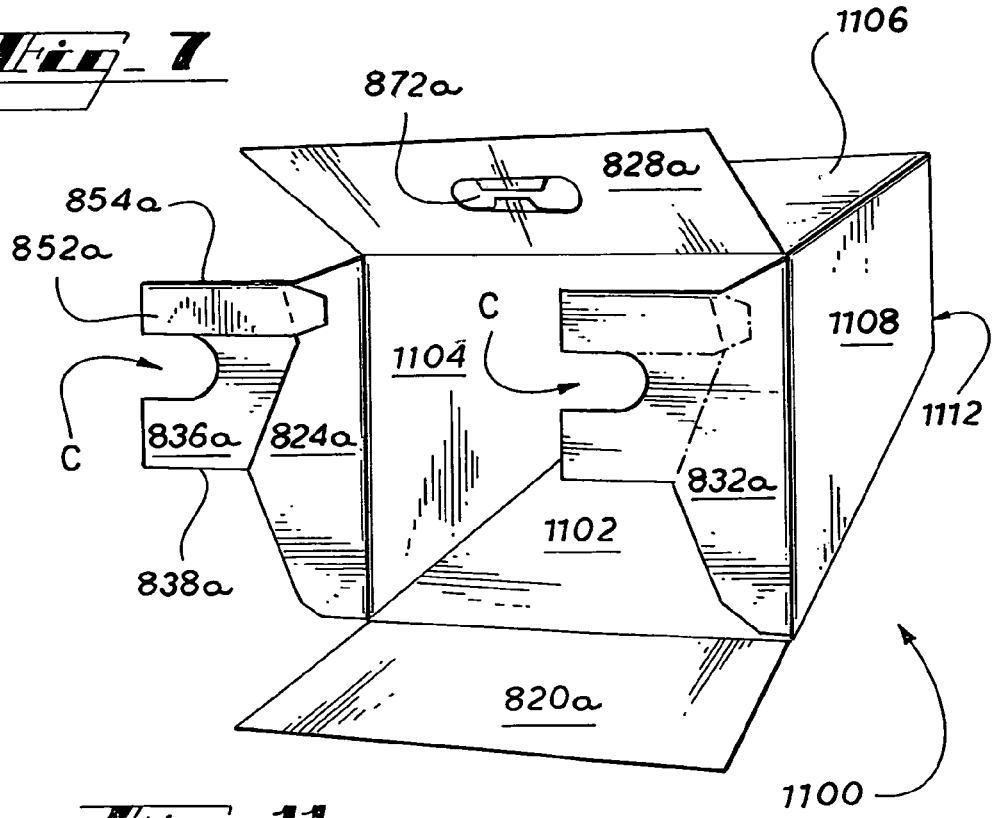
FIG. 11 is a perspective view of a partially erected carton formed from the blank of FIG. 8, prior to sealing one of its end closures.

As mentioned above, the handle opening 872*a* and notched cutouts, 874*a*, 87*a*, 878*a*, 880*a* have complementary shapes, dimensions, and positions so as to be placed in registry with one another when the overlay panels 83*a*, 846*a* and the end flaps 824*a*, 828*a*, 832*a* are folded to overlie, overlap, or abut one another to form a first end closure 1110 (not shown). Similarly, the handle opening 872*b* and notched cutouts,

874*b*, 876*b*, 878*b*, 880*b* are complimentarily shaped, dimensioned, and positioned so as to be placed in registry with one another when the overlay panels 836*b*, 846*b* and the end flaps 824*b*, 828*b*, 832*b* are folded to overlie, overlap, or abut one another to form a second end closure 1112 (obstructed in FIG. 11).

The exemplary carton 1100 may be erected around an article or group of articles, or may be at least partially erected and then loaded and sealed. To facilitate an understanding of the configuration of the carton 1100, one of potentially many contemplated techniques for erecting the carton 1100 will now be described as a series of steps that may be performed substantially simultaneously or in any practical order, with some or all of the steps being performed either manually or automatically, such as by a packaging machine.

The exemplary process of erecting the carton is performed in two stages. The first stage is performed typically as part of the process of manufacturing the carton 1100. In the first stage, a blank is cut, folded and then secured into a flattened tubular condition so that it can be shipped to a packing facility as a sleeve. The following are the details: In plant equipment (IPE) at the manufacturing site cuts the blank 800 from a single sheet of foldable sheet material as described above, and cut, scores, imprints or otherwise defines fold lines, severance lines, and cutout sections. For instance, the edges 873*a*, 873*b*, 875*a*, 875*b*, 877*a*, 877*b*, 879*a*, 879*b*, 881*a*, 881*b* of handle openings 872*a*, 872*b* and notched cutouts 874*a*, 874*b*, 876*a*, 876*b*, 878*a*, 878*b*, 880*a*, 880*b* may be defined by frangible lines or perforations enabling the center sections to be punched out, or may be defined by cut lines with the center sections being removed and discarded before the carton 1100 is erected.

After the blank 800 is cut out in the form shown in FIG. 8, adhesive or other means for securing sheet material is applied to the inside surface of the overlay panels 836*a*, 836*b*, 846*a*, 846*b* and the reinforcing panels 852*a*, 852*b*, 860*a*, 860*b*. At or about the same time: overlay panel 836*a* is folded about fold line 838*a* so that its inside surface is in face contacting arrangement with the underlying portion of the inside surface of first side end flap 824*a*; overlay panel 836*b* is folded about 838*b* so that its inside surface is in face contacting arrangement with the underlying portion of the inside surface of first side end flap 824*b*; overlay panel 846*a* is folded about 848*a* so that its inside surface is in face contacting arrangement with the underlying portion of the inside surface of second side end flap 832*a*; and overlay panel 846*b* is folded about fold line 848*b* so that its inside surface is in face contacting arrangement with the underlying portion of the inside surface of second side end flap 832*b*. In this manner, the overlay panels 836*a*, 836*b*, 846*a*, 846*b* are secured to the underlying portions of the inside surfaces of side end flaps 824*a*, 824*b*, 832*a*, 832*b*, respectively, and the notched cutouts 876*a*, 876*b*, 880*a*, 880*b* align with the notched cutouts 874*a*, 874*b*, 878*a*, 878*b*, respectively.

Then, or about the same time: first reinforcing panel 852*a* is folded about fold line 854*a* so that its inside surface is in face contacting arrangement with the underlying portion of the outside surface of first overlay panel 836*a* and the underlying portion of the inside surface of first side end flap 824*a*; first reinforcing panel 852*b* is folded about fold line 854*b* so that its inside surface is in face contacting arrangement with the underlying portion of the outside surface of first overlay panel 836*b* and the underlying portion of the inside surface of first side end flap 824*b*; second reinforcing panel 860*a* is folded about fold line 862*a* so that its inside surface is in face contacting arrangement with the underlying portion of the outside surface of second overlay panel 846*a* and the underlying portion the inside surface of the second side end flap 832*a*; second reinforcing panel 860*b* is folded about fold line 862*b* so that its inside surface is in face contacting arrangement with the underlying portion of the outside surface of second overlay panel 846*b* and the underlying portion of the inside surface of second side end flap 832*b*. By this means, the reinforcing panels 852*a*, 852*b*, 860*a*, 860*b* are secured to the underlying portions of the outside surfaces of overlay panels 836*a*, 836*b*, 846*a*, 846*b* and to the underlying portions of the inside surfaces of the inside surfaces of side end flaps 824*a*, 824*b*, 832*a*, 832*b*, respectively.

Figure 9:
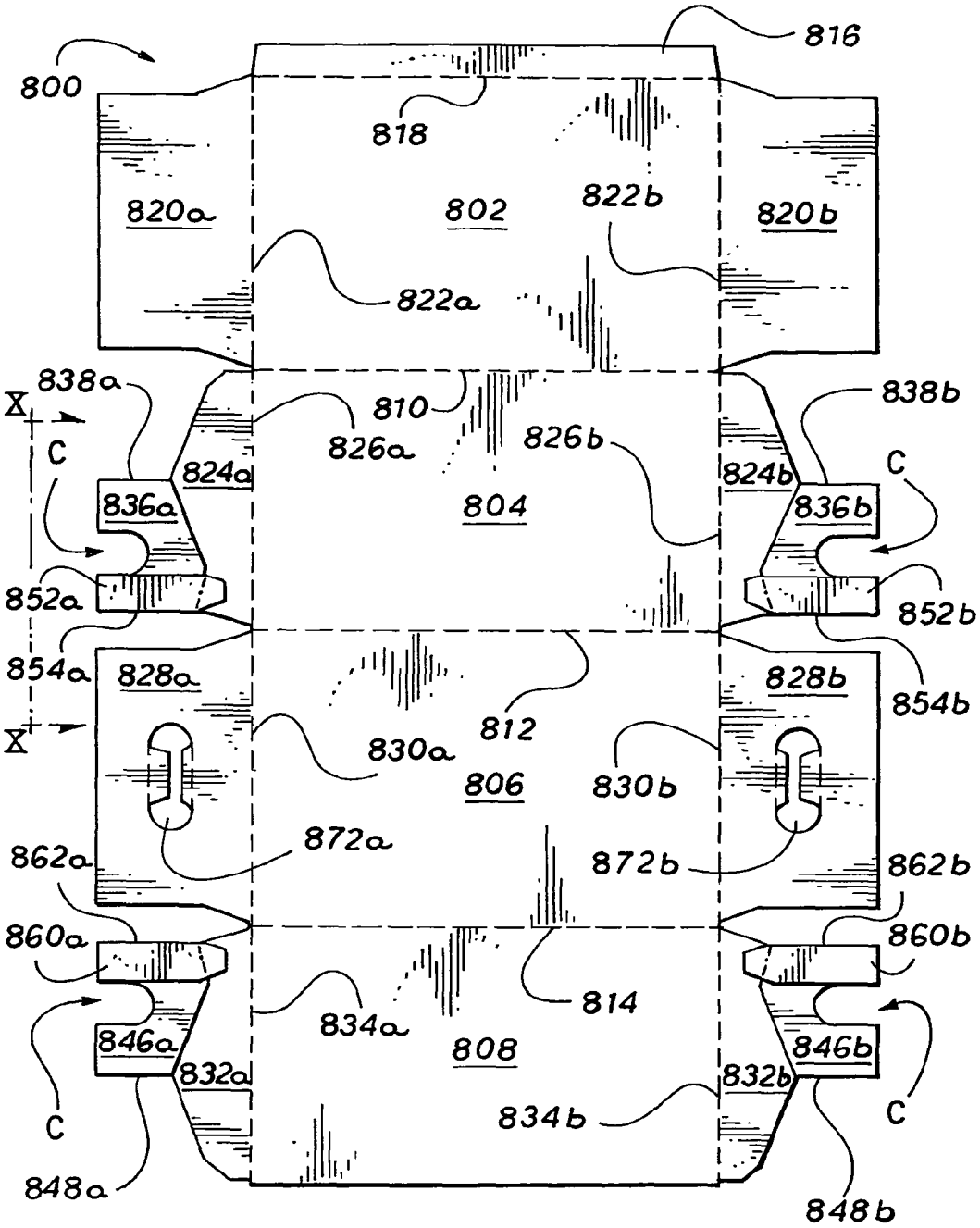
FIG. 9 is a plan view of the blank of FIG. 8, with overlay panels and reinforcing panels folded over and secured to the side end flaps.
Figure 10:
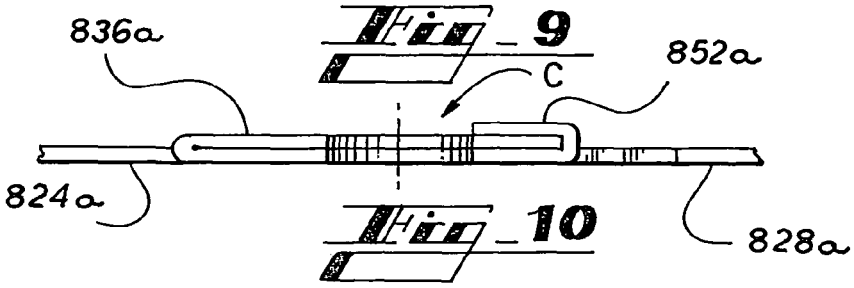
FIG. 10 is an end view taken along the line X-X in FIG. 9, showing an exemplary overlay panel and an exemplary reinforcing panel in face contacting arrangement with a side end flap.

At this point, the blank 800 is configured as shown in FIG. 9. The overlay panels 836*a*, 836*b*, 846*a*, 846*b* are folded over onto respective side end flaps 824*a*, 824*b*, 832*a*, 832*b* to form two-ply cutouts C. By additionally folding the reinforcing panels 852*a*, 852*b*, 860*a*, 860*b* over onto respective overlay panels 836*a*, 836*b*, 846*a*, 846*b*, the coextensive edge of each cutout C is three-ply. FIG. 10 is an end view taken along X-X in FIG. 9, which shows the end edge of first side end flap 824*a*, first overlay panel 836*a*, and first reinforcing panel 852*a*, to aid in understanding the relationship between each of the reinforcing panels, overlay panels, and the respective side end flaps.

The first phase of the process is completed by applying adhesive or other securing means to the outside surface of edge flap 816, folding edge flap 816 so that its inside surface is in face contacting arrangement with the inside surface of bottom panel 802, and folding the entire blank 800 along fold line 812 so that the inside surface of top panel 802 is in face contacting arrangement with the inside surface of second side panel 808 and the outside surface of edge flap 816 is secured to the inside surface of second side panel 808.

The second stage of erecting the carton 1100 may be performed at a bottling or packaging facility. The flattened blanks 800 are loaded into a packaging machine, which in known fashion, disposes top panel 806 opposite bottom panel 802 and disposes first side panel 804 opposite second side panel 808 so that the carton 1100 is configured as a tubular sleeve having a substantially rectangular as shown in FIG. 11, although trapezoidal or gabled cross sections are also contemplated. Thus, top panel 806 becomes top wall 1106, first side panel 804 becomes first side wall 1104, bottom panel 802 becomes bottom wall 1102, and second side panel 808 becomes second side wall 1108.

Articles are loaded into the carton 1100 through one or both of the now open ends, and then the ends are sealed. The ends of the carton 1100 are substantially identical, with similar parts being identified using the same element number modified by the suffix "a" or "b", where element numbers ending in "a" are associated with end closure 1110 (not shown) and elements identified with "b" are associated with end closure 1112. Accordingly, formation of only one of the end closures 1110, 1112 will be described in detail below.

As can be seen in FIG. 11, first side panel 824*a* and second side panel 832*a* are simultaneously or independently folded toward the interior of the carton 1100 until side end flaps 824*a*, 832*a* abut or overlap somewhat. In this manner, the cutouts C come together to approximate the dimensions of handle opening 872*a*. It should be noted that handle opening 872*a* may be relatively larger or smaller to account for slight variations in alignment. Adhesive is applied to the inside surface of bottom end flap 820*a*, and bottom end flap 820*a* is folded toward the interior of the carton 1100 so that its inside surface is secured in a face contacting arrangement to the lower portions of the outside surfaces of side end flaps 824*a*, 832*a*. Adhesive is applied to the inside surface of top end flap 828*a*and top end flap 828*a* is folded toward the interior of the carton 1100 so that its inside surface is secured in a face contacting arrangement to the upper portions of the outside surfaces of side end flaps 824*a*, 832*a*. Top end flap 828*a* may overlap bottom end flap 820*a* somewhat, or conversely, bottom end flap 820*a* may overlap top end flap 828*a*. As another alternative, top end flap 828*a* may abut or be spaced apart from bottom end flap 820*a* with neither overlapping the other.

Once the carton 1100 is fully erected, each end closure 1110, 1112 includes a handle, the edges of which being triply reinforced. In other words, a portion of the periphery of the handle as defined by handle opening 872*a* is substantially aligned with and reinforced by the three-ply cutouts C to make the upper edge of the handle four plies thick. Those skilled in the art will readily appreciate that reinforcement is most needed along the weight-bearing or hand-engaging portion of a handle opening in a carton.

Figure 12:
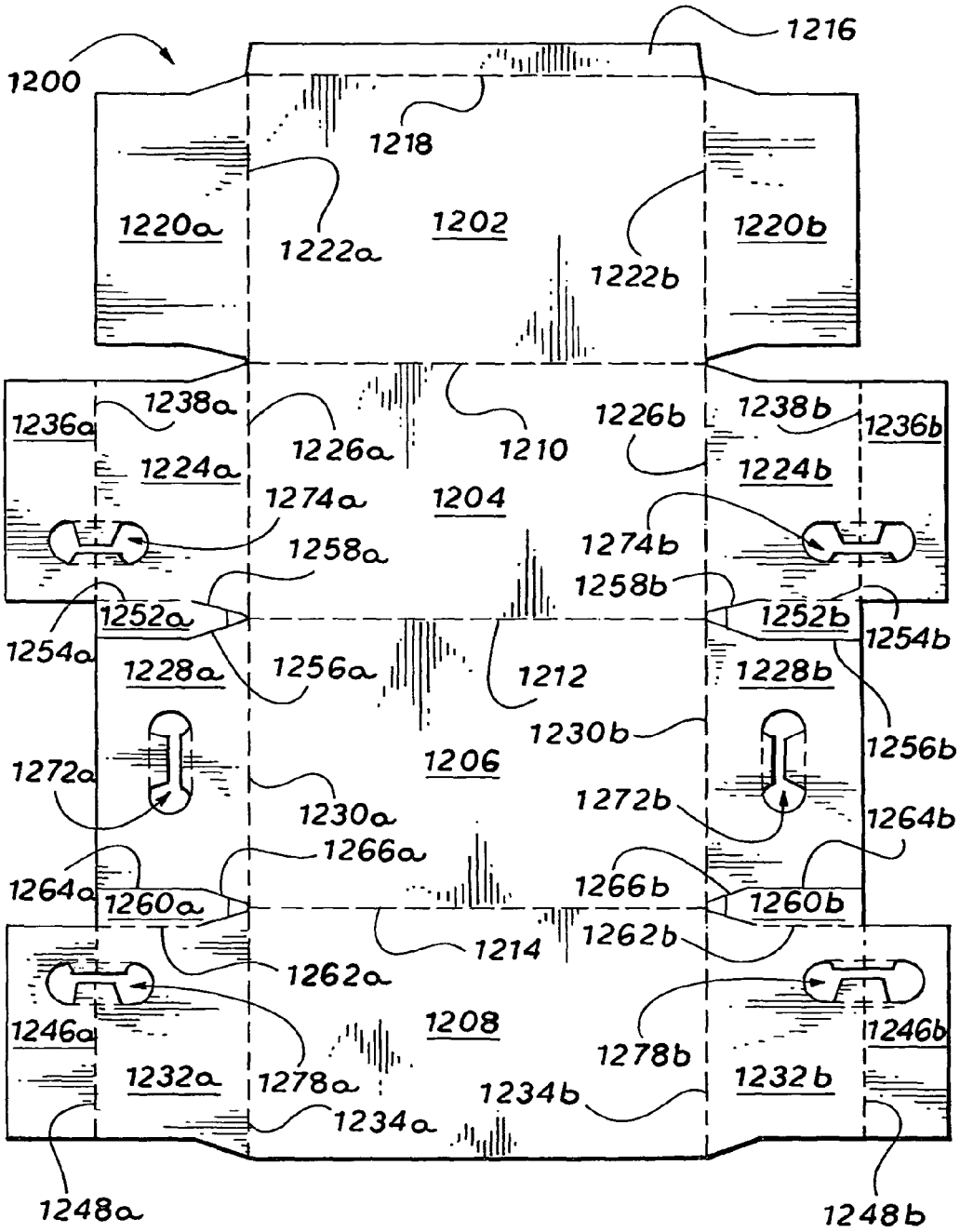
FIG. 12 is a plan view of a fourth alternative embodiment of a blank for forming a carton with reinforced end handles.

A fourth embodiment will now be described to exemplify the principles and teachings of the present invention. A carton (not shown) is formed from a blank 1200 (as shown in FIG. 12) and embodies an alternative configuration that provides triple reinforcement of the handle H. Generally, the blank 1200 differs from the blank 800 principally by the substitution of handle openings 1274*a*, 1274*b*, 1278*a*, 1278*b* that are disposed in an alternate configuration of the side end flaps 1224*a*, 1224*b*, 1232*a*, 1232*b* and overlay panels 1236*a*, 1236*b*, 1246*a*, 1246*b*. In the alternate configuration, each overlay panel 1236*a*, 1236*b*, 1246*a*, 1246*b* is hingedly connected to a respective side end flap 1224*a*, 1224*b*, 1232*a*, 1232*b* along a fold line 1238*a*, 1238*b*, 1248*a*, 1248*b*. Each handle opening 1274*a*, 1274*b*, 1278*a*, 1278*b* is symmetrically bisected by an imaginary line coextensive with the fold line 1238*a*, 1238*b*, 1248*a*, 1248*b* such that when the overlay panels 1236*a*, 1236*b*, 1246*a*, 1246 are folded along the respective fold line 1238*a*, 1238*b*, 1248*a*, 1248*b* to be in a face contacting relationship with the side end flaps 1224*a*, 1224*b*, 1232*a*, 1232*b*, notched cutouts (not shown) are formed. The reinforcing panels 1252*a*, 1252*b*, 1260*a*, 1260*b* may be secured beneath the overlay panels 123*a*, 1236*b*, 124*a*, 1246, but are preferably folded and secured after the overlay panels 1236*a*, 1236*b*, 1246*a*, 1246 have been secured to the side end flaps 1224*a*, 1224*b*, 1232*a*, 1232*b*.

The elements of blank 1200 and the carton (not shown) are otherwise substantially similar to the corresponding elements of blank 800 and carton 1100. For instance, the bottom panel 802 is substantially identical to bottom panel 1202. Further, the blank 1200 is erected to form the carton by substantially the same process as described above where blank 800 is erected to form the carton 1100.

The present invention has been illustrated in relation to a particular embodiment which is intended in all respects to be illustrative rather than restrictive. For example, as used herein, directional references such as "top", "base", "bottom", "end", "side", "inner", "outer", "upper", "middle", "lower", "front" and "rear" do not limit the respective walls of the carton to such orientation, but merely serve to distinguish these walls from one another. Furthermore, the various embodiments demonstrate that the top, sides, and bottom panels may be hingedly connected to one another and secured into a tubular sleeve in any order that provides a top panel opposing a bottom panel and opposing side panels. Any reference to hinged connection should not be construed as necessarily referring to a junction including a single hinge only; indeed, it is envisaged that hinged connection can be formed from one or more potentially disparate means for hingedly connecting materials. The exemplary cartons preferably have handles at both ends, although it is contemplated to include only one handle disposed in one of the end closures.

Those skilled in the art will also appreciate that any suitable means for securing sheet material may be used, including magnets, non-permanent adhesives, or hook and loop fasteners such as VELCRO®, which is a trademark registered to Velcro Industries B.V. Additionally, although the handle openings of the invention are described as having removable centers, the centers may be only partially removable and may function as finger cushions after being partially detached from the edges of the handle openings.

It must be emphasized that the law does not require and it is economically prohibitive to illustrate and teach every possible embodiment of the present claims. Hence, the above-described embodiments are merely exemplary illustrations of implementations set forth for a clear understanding of the principles of the invention. Many variations and modifications may be made to the above-described embodiments without departing from the scope of the claims. Accordingly, all such modifications, combinations, and variations are included herein by the scope of this disclosure and the following claims.

What is claimed is:

1. A carton, comprising:

a tubular structure comprising a top wall, a bottom wall, a first side wall, and a second side wall; and an end closure structure, comprising:

a top end flap hingedly connected to the top wall, the top end flap comprising a handle opening;

a first side end flap and a second side end flap hingedly connected to the first side wall and the second side wall, respectively, each side end flap comprising a cutout having dimensions complementary to the dimensions of at least part of the handle opening, wherein the top end flap is folded to at least partially overlie the first and second side end flaps so that the handle opening is in registry with the cutouts, the each side end flap having an upper edge disposed substantially parallel to the top wall; and a first reinforcing panel and a second reinforcing panel hingedly connected to and along the upper edge of the first side end flap and to and along the upper edge of the second side end flap, respectively, each reinforcing panel is folded and disposed in face contacting arrangement with a respective said side end flap to place a reinforcing edge in reinforcing proximity to a respective said cutout.

2. The carton of claim 1, further comprising a first overlay panel and a second overlay panel hingedly connected to a lower edge of the first side end flap and to a lower edge of the second side end flap, respectively, the first and second overlaying panels being in face contacting arrangement with the first and second reinforcing panels respectively.

3. The carton of claim 2, wherein each overlay panel comprises a cutout having dimensions complementary to the dimensions of at least part of the handle opening.

4. The carton of claim 1, wherein the each reinforcing panel extends downward from the upper edge of the respective said side end flap.

5. The carton of claim 1, wherein a fold line connects the each reinforcing panel to the respective said side end flap, the fold line defining a common upper edge that is shared by the each reinforcing panel and the respective said side end flap.

6. The carton of claim 5, wherein the each reinforcing panel extends from the common upper edge to a lower edge of the each reinforcing panel, and the lower edge of the each reinforcing panel is placed in reinforcing proximity to a weight-bearing portion of the cutout of the respective said side end flap.

7. The carton of claim 1, wherein the each reinforcing panel is disposed along an inside surface of the respective said side end flap.

8. The carton of claim 7, wherein the each reinforcing panel is secured to the inside surface of the respective said side end flap.

9. The carton of claim 1, wherein the each reinforcing panel is connected only to the respective said side end flap and is separated from the remainder of the carton.

10. A carton blank, comprising:

a top panel, a bottom panel, a first side panel, and a second side panel configured to form the respective walls of a tubular structure, the top panel being hingedly connected to at least one of the first side panel and the second side panel; and a plurality of end flaps configured to form an end closure structure, comprising:

a top end flap hingedly connected to the top panel, the top end flap comprising a handle opening:

first and second side end flaps hingedly connected respectively to the first and second side panels, each side end flap comprising:

a cutout having dimensions complementary to the dimensions of at least part of the handle opening; and a reinforcing panel hingedly connected to the each side end flap such that each reinforcing panel is foldable to be in face contacting arrangement with a respective said side end flap, the each reinforcing panel being separate from a respective said side wall, wherein the hinged connection connecting the top panel and the at least one of the first side panel and the second side panel is substantially parallel to the hinged connection connecting the each reinforcing panel and the respective said side end flap.

11. The carton blank of claim 10, wherein a part of the each side end flap separates a respective said reinforcing panel from a respective said side panel.

12. The carton blank of claim 10, wherein the each reinforcing panel is detached from the top end flap along a severance line, the severance line defines an edge common to both the each reinforcing panel and the top end flap.

13. The carton blank of claim 10, wherein the each reinforcing panel fills a space between the respective said side end flap and the top end flap.

14. The carton blank of claim 10, wherein the length of the top end flap and the length of each side end flap are greater than the length of each reinforcing panel, each of the length of the top end flap and the length of the each side end flap being measured from a hinged connection to an outer edge.

15. The carton blank of claim 10, wherein the width of a space between the top end flap and each side end flap is substantially equal to the distance between the hinged connection connecting the each side end flap and a respective reinforcing panel and a respective cutout.

16. The carton blank of claim 10, wherein the each reinforcing panel extends from the respective said side end flap all the way to the top end flap.

17. A carton blank, comprising:

a top panel, a bottom panel, a first side panel, and a second side panel configured to form the respective walls of a tubular structure, the top panel being hingedly connected to at least one of the first side panel and the second side panel; and a plurality of end flaps configured to form an end closure structure, comprising:

a top end flap hingedly connected to the top panel, the top end flap comprising a handle opening;

first and second side end flaps hingedly connected respectively to the first and second side panels, each side end flap comprising:

a cutout having dimensions complementary to the dimensions of at least part of the handle opening; and a reinforcing panel hingedly connected to the each side end flap such that each reinforcing panel is foldable to be in face contacting arrangement with a respective said side end flap, the each reinforcing panel being separate from a respective said side wall, wherein a part of the each side end flap separates a respective said reinforcing panel from a respective said side panel, wherein the each reinforcing panel is detached from the top end flap along a severance line, wherein the severance line defines an edge common to both the each reinforcing panel and the top end flap, and wherein the severance line and the hinged connection connecting the each reinforcing panel to the respective said side end flap are substantially parallel.

18. A carton blank, comprising:

a top panel, a bottom panel, a first side panel, and a second side panel configured to form the respective walls of a tubular structure, the top panel being hingedly connected to at least one of the first side panel and the second side panel; and a plurality of end flaps configured to form an end closure structure, comprising:

a top end flap hingedly connected to the top panel, the top end flap comprising a handle opening;

first and second side end flaps hingedly connected respectively to the first and second side panels, each side end flap comprising:

a cutout having dimensions complementary to the dimensions of at least part of the handle opening; and a reinforcing panel hingedly connected to the each side end flap such that each reinforcing panel is foldable to be in face contacting arrangement with a respective said side end flap, the each reinforcing panel being separate from a respective said side wall, wherein each of the top end flap, the side end flaps and the reinforcing panels include an outer edge, and the outer edges are substantially collinear.

19. A carton blank, comprising:

a top panel, a bottom panel, a first side panel, and a second side panel configured to form the respective walls of a tubular structure, the top panel being hingedly connected to at least one of the first side panel and the second side panel; and a plurality of end flaps configured to form an end closure structure, comprising:

a top end flap hingedly connected to the top panel, the top end flap comprising a handle opening;

first and second side end flaps hingedly connected respectively to the first and second side panels, each side end flap comprising:

a cutout having dimensions complementary to the dimensions of at least part of the handle opening; and at least one reinforcing panel hingedly connected to at least one of the first and second side end flaps such that the at least one reinforcing panel is foldable to be in face contacting arrangement with the at least one of the first and second side end flaps, the at least one reinforcing panel being separate from the side walls, wherein the hinged connection connecting the top panel and the at least one of the first side panel and the second side panel is substantially parallel to the hinged connection connecting the at least one reinforcing panel and the at least one of the first and second side end flaps.

20. The carton of claim 19, wherein the at least one reinforcing panel is detached from the top end flap along a severance line, wherein the severance line defines an edge common to the at least one reinforcing panel and the top end flap, and wherein the severance line and the hinged connection connecting the at least one reinforcing panel to the at least one side end flap are substantially parallel.

* * * * *